US005171158A

United States Patent [19]

Cairns

[11] Patent Number: 5,171,158

[45] Date of Patent: Dec. 15, 1992

[54] UNDERWATER MULTIPLE CONTACT ELECTRICAL CONNECTOR

[76] Inventor: James L. Cairns, 1689 State Ave., Holly Hill, Fla. 32017

[21] Appl. No.: 758,386

[22] Filed: Sep. 3, 1991

Related U.S. Application Data

[63] Continuation of Ser. No. 507,626, Apr. 11, 1990, abandoned.

[51] Int. Cl.[5] ..... H01R 13/523

[52] U.S. Cl. ..... 439/199; 439/190

[58] Field of Search ..... 439/190, 199, 201, 205, 439/206, 197

[56] References Cited

U.S. PATENT DOCUMENTS

| | | | |
|---|---|---|---|
| 3,508,188 | 4/1970 | Buck | 439/199 |
| 3,643,207 | 2/1972 | Cairns | 439/201 |
| 3,729,899 | 4/1973 | Briggs et al. | 439/199 |
| 4,085,993 | 4/1978 | Cairns | 439/201 |
| 4,174,875 | 11/1979 | Wilson et al. | 439/199 |
| 4,373,767 | 2/1983 | Cairns | 439/199 |
| 4,589,717 | 5/1986 | Pottier et al. | 439/190 |
| 4,606,603 | 8/1986 | Cairns | 439/206 |
| 4,859,196 | 8/1989 | Durando et al. | 439/197 |

*Primary Examiner*—Larry I. Schwartz
*Assistant Examiner*—Kevin J. Carroll
*Attorney, Agent, or Firm*—Brown, Martin, Haller & McClain

[57] ABSTRACT

An underwater electrical connector of the plug and socket type intended for use in underwater environments, including a dielectric fluid-filled bladder having a sealed port with a movable dielectric stopper that moves from the first position of sealing the port to a second position of exposing electrical sockets to a probe having multiple electrical contacts. The probe is moved through the port and against the stopper, pushing the stopper to a retracted position where the electrical contacts electrically mate with the sockets. A plurality of wipers are positioned in the bladder with at least one between each of the electrical sockets, which wipers seal against the outer surface of the probe forming separate sealed, wiper chambers enclosing the electrical connection between each of the contacts and sockets. The outer diameter of the stopper is smaller than the inner diameter of the wipers, providing dielectric fluid communication passage between the several chambers.

3 Claims, 3 Drawing Sheets

UNDERWATER MULTIPLE CONTACT ELECTRICAL CONNECTOR

This is a continuation of application Ser. No. 07/507,626, filed Apr. 11, 1990, now abandoned.

BACKGROUND OF THE INVENTION

This invention concerns an underwater electrical connector using a single probe to provide multiple electrical connections. Each of the electrical connections are separately sealable in a dielectric bath chamber, which chambers are in fluid communication with the other chambers. The seals provide multiple wiping of the electrical contacts on the probe prior to making the electrical connection. This removes contamination from the probe in the high pressure sea water environment and maintains an uncontaminated environment in separate, sealed chambers for separately enclosing each of the electrical connections, made by the single male probe. The respective chambers have dielectric fluid communication with each other in the disconnected condition.

The inventor has been a leader and pioneer in use of flexible, fluid-filled bladders with self sealing ports to protect electrical contact surfaces from contamination in making electrical connections in underwater environments. The genesis of this major development in underseas electrical and optical connector technology is found in the inventor's U.S. Pat. Nos. 3,643,207; 4,085,993; and 4,606,603. These Patents teach the use of a flexible, fluid-filled chamber in a connector that makes connection in either high pressure or low pressure environments, which chambers provide fluid pressure equalization between a protective environment internal to the bladder and the outer high pressure or low pressure environment, such as high-pressure corosive seawater in the deep ocean where the connector has a primary, advantageous use. The electrical (or optical) pathway is completed by insertion of a contact carrying probe through a reclosable end seal integral with the bladder. This insertion can be made in the high pressure or low pressure environment. When the probe extends through the end or port seal, the barrier between the interior of the bladder and the outside environment results from the pressure of the end seal material against the probe. When the probe is withdrawn, the barrier must be maintained. Generally the environmental sealing relies on the compression of the end seal material to provide a sealing compression to close the opening both during electrical connections and during disconnections. The inventor has found that the environmental sealing cannot rely solely upon the compression of the sealed material, because the material "forgets to close", especially when mated to a probe for a long period of time in cold ocean water. This reluctance to close results in leakage of fluid from the interior of the bladder, and the leakage of outside water into the bladder. Since the connecting surfaces within the bladder in the form of sockets are contained within the common chamber formed by the bladder, entry of water into the bladder poses the risk of conductive path formation between multiple in line electrical connections.

A significant development stage in the progress of fluid-filled bladder technology was reached with the design of a coaxial connector having a long, sturdy male probe in a holder, which supported multiple electrical contacts. In addition, in the bladder the end seal operation was enhanced by the use of a stopper that is positioned in the port, sealing the port when there was no electrical connection. The stopper is pushed back by the entry of the probe to make an electrical connection, with the probe then passing through the port and maintaining the seal. In this development, the constricted, resilient opening of the port wipes the end of the stopper in its retracted movement, wipes the probe clean as it enters the chamber, and seals tight against the probe while it is in the electrically connected position. While the use of a stopper aids in maintaining the port seal around both the stopper and the inserted probe, there is still a problem with the probe causing irregularities on the respective surfaces of the probe and the port seal, allowing seawater to penetrate and interfere with the electrical connections made. This problem can escalate by irregularities on the probe, resulting from multiple contacts on the probe for making the multiple electrical connections with multiple electrical sockets in the chamber.

Accordingly, the invention laid out in the description to follow advances the fluid-filled bladder technology for submersible connectors by providing multiple electrical connections through the single contact of male and female connectors in a dielectric chamber having multiple inner wipers that wipe the outer surfaces of the respective stopper and probe, in making the electrical connection.

In addition, the present invention provides multiple, fluid innerconnecting, dielectric bath chambers, each of which encloses individual electrical connections of a plurality of electrical connections between contacts on a probe and sockets in the bladder.

The invention further provides internal dielectric fluid communication between the wiper chambers during disconnection of the connector.

Accordingly a principle objective of the described invention is to provide a new and improved underwater or submersible connector utilizing a dielectric fluid-filled bladder containing multiple electrical sockets for making an electrical connection with multiple contacts on a male probe, in which the probe is subjected to multiple wipings in making the electrical connection, and in the connected position the individual electrical connections are separately sealed in dielectric bath wiper chambers in the bladder.

SUMMARY OF THE INVENTION

The invention is based upon the realization and use by the inventor of a movable stopper, operating within the fluid-filled bladder environment of the connector, to protrude through the end seal port through which the connector probe is inserted, to maintain the pressure seal protection of the interior of the bladder without need for the constricting elements of the prior art. So when the probe is inserted and the stopper is moved by the probe to a retracted position, the probe in the opening completes the seal.

In this embodiment, the inventor has determined that the overall effectiveness of the sealing of the bladder can be improved by further providing multiple internal wiping in the flexible chamber of the stopper and the probe when the electrical connection is made, and also using the wipers to form a plurality of dielectric wiper bath chambers in the flexible chamber, in which each of the electrical connections made between electrical contacts on the probe and electrical sockets are enclosed in a separately sealed, dielectric wiper bath chamber. This restricts the entry of seawater into the chamber, and requires the seawater to pass through a plurality of internal wiper chambers, and also provides individual sealing of the electrical connections made within the dielectric fluid chamber. Yet, there is fluid communication within the chamber of all the respective internal, dielectric bath chambers, when there is no electrical connection. This permits the dielectric fluid to bathe and yet be wiped from the passing stopper or probe, and aids in removing, diluting or isolating seawater or impurities that may get through the restricted opening in making the electrical connection, and prevents the dielectric fluid bath from being unreasonably diluted by outside seawater or other impurities. The unique communication of the dielectric fluid between the respective dielectric wiper chambers is accomplished by having individual wipers that make circumferential contact with the probe. These wipers are positioned between respective electrical receptacles in the dielectric chamber, and wipe the probe in its movement through the channel against the stopper. This seals the respective electrical connections in a dielectric bath when the probe is in the electrically connected position. Yet, the stopper has a diameter smaller than that of the probe and also smaller than the internal diameter of the opening in the respective wipers, which assures fluid communication within the dielectric bath chambers in the unconnected condition.

The summarized invention therefore, achieves the objective of allowing multiple connections to be made through the single connection of a probe to a multiple receptacle female socket, with the use of a movable stopper, and with fluid communication around the stopper and in the respective wiper chambers during the unconnected condition, and that provides individual sealing in separate dielectric chambers of each electrical connection being made.

The achievement of these and other objects and advantages of the invented connector will be better understood when the detailed description of the invention given below, is read with reference to the next-summarized illustrations, in which.

DETAILED DESCRIPTION OF THE PREFERRED EMBODIMENT

Figure 1:
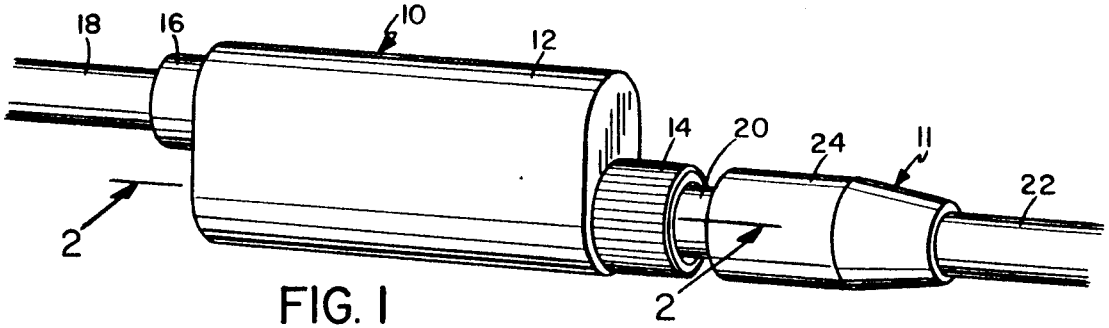
FIG. 1 is a pespective view of the assembled connector.

FIGS. 1-7 illustrate in various levels of detail, the structure and operation of the multiple contact electrical connector assembly that is used in the invention. The electrical connector portion 10 includes an outer molded body 12 preferably of hard plastic that is formed of two parts that are joined together. The body is connected to a male probe plug 11 by a threaded connection that includes member 14, which has threads 118 that engage the threads 26, see FIGS. 3 and 4. This threaded connection draws plug 24 into contact with receptacle 12, with the respective mating tooth surfaces 30 on receptacle 10 contacting the mated tooth surface 110 in the plug 24. These mating tooth surfaces keep the plug and receptacle from rotating after being mated. The electrical input to the plug is through cable 22, and the electrical input to the electrical receptacle 10 is provided by cable 18.

The molded body 12 encloses a molded assembly 36 that is molded around the input cable 18 as defined by the ring opening 92. The individual wires 38, 41 and 42 of the input cable 18 are connected to respective electrical sockets 40, 44 and 45. These sockets comprise copper connectors, see FIG. 6, that have inward, circular indentations 49 that make electrical connection with contacts 102, 104 and 106 of the male probe 100, see of FIG. 4.

A flexible dielectric chamber 72 extends from an opening 35 of the molded assembly 36 through a channel and into a flexible bladder 70 positioned within the molded assembly. The flexible bladder 70 may be made of any suitable material such as natural or synthetic rubber, which bladder encloses a guide tube 68. The open end 80 of the bladder 70 is interlocked with an end 81 of a molded assembly 36. This holds the bladder 70 in sealed condition along surface 89 against the outer environment. The bladder 70 is further retained in position by the openings in the circular skeleton rings 76 and 78 that forms a part of the molded body 12. This frame also presses the bladder against the outer surface of the guide tube 68, holding the guide tube in position and also maintaining an additional seal of the dielectric fluid in chamber 72 that is in the flexible bladder 70. The bladder 70 has an expansion area 69 that allows expansion of the fluid as may be necessary to equalize the pressure of the dielectric fluid with the outer seawater or ambient atmospheric environment. Molded washer 90 retains the guide tube 68 from lateral motion.

Figure 2:
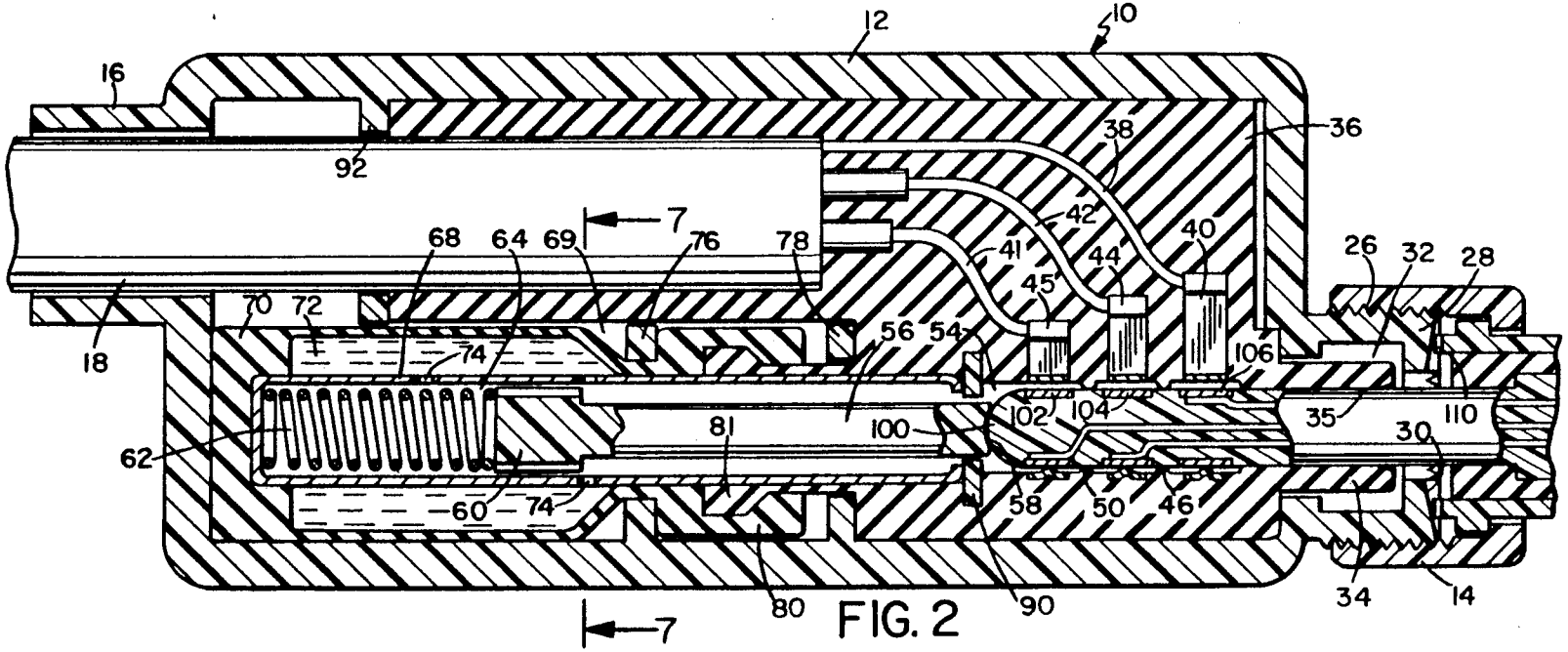
FIG. 2 is an enlarged sectional view taken on line 2—2 of FIG. 1.
Figure 3:
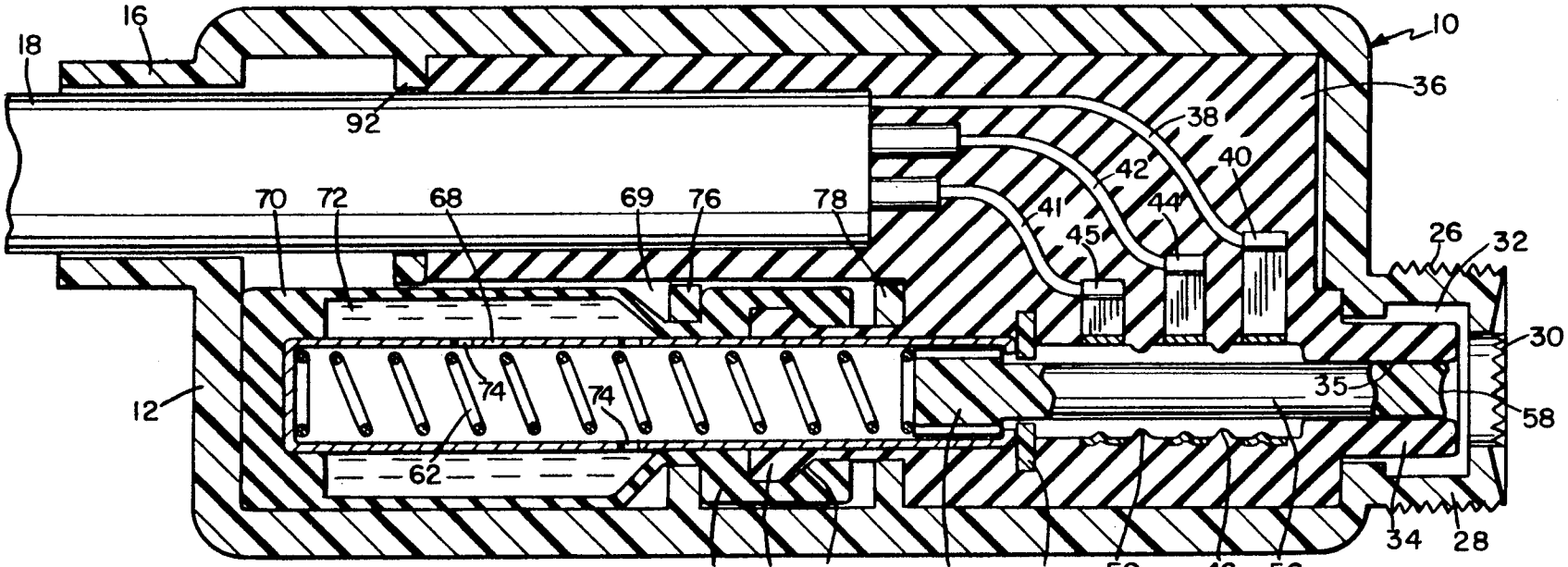
FIG. 3 is a similar sectional view of the socket or receptacle portion of the connector.

A dielectric, cylindrical stopper 56 is positioned in a channel in the molded assembly 36, and is movable from the illustrated forward or sealing position in FIG. 3 to a retracted position against spring 62, as illustrated in FIG. 2. The stopper 56 has a fluted end 60, see FIG. 7, that allows communication of the dielectric fluid from the outer volume of chamber 72 through holes 74 and around the fluted end 60 to respectives dielectric bath chambers 47, 48 and 54 in the channel, see FIG. 5. This allows dielectric fluid communication spaces in chamber 72.

Molded-in rubber nibs or wiper seals 46 and 50, do not seal against the stopper 56 because the outer diameter of the cylindrical stopper is smaller than the contracted inner diameter of the respective wipers 46 and 50. As will be described in more detail hereinafter, and as is illustrated in FIG. 2, the outer diameter of the cylindrical probe 100 is larger than the outer diameter of stopper 56, and is also larger than the inner diameter of the wiper elements 46 and 50. The wipers 46,50 form sealable openings for the dielectric bath chambers 47, 48, and 54 in the chamber 72. The chamber 72 has a port 34, which comprises an internal compression elastic port opening that resiliently presses against the outer surface of stopper 56 and forms a seal against entry of seawater or the like from the outside environment. It being recognized that the internal pressure within the dielectric chamber 72 and the pressure of the outside water environment are equalized across the sealed opening 35.

Figure 4:
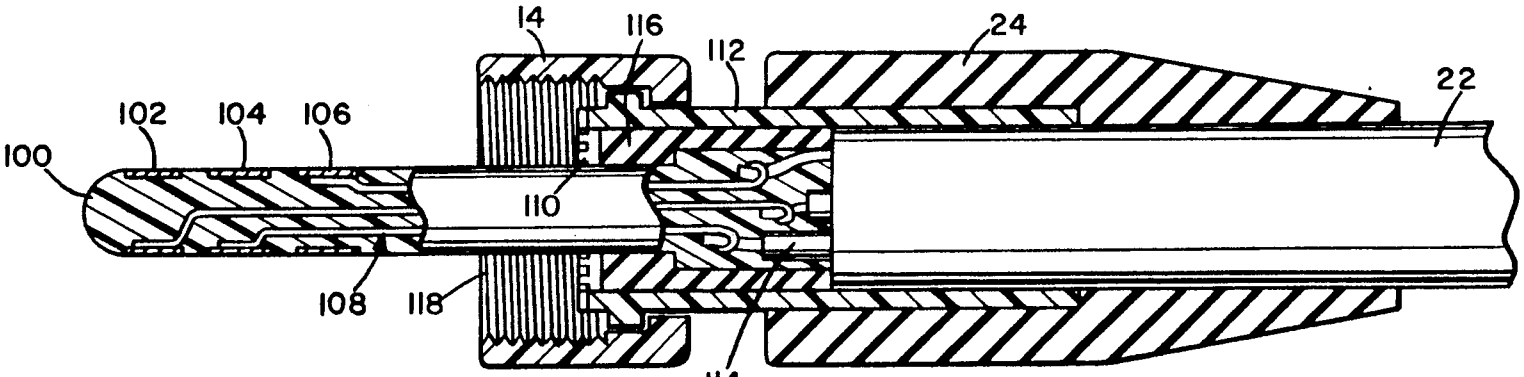
FIG. 4 is a similar sectional view of the plug portion of the connector.
Figure 6:
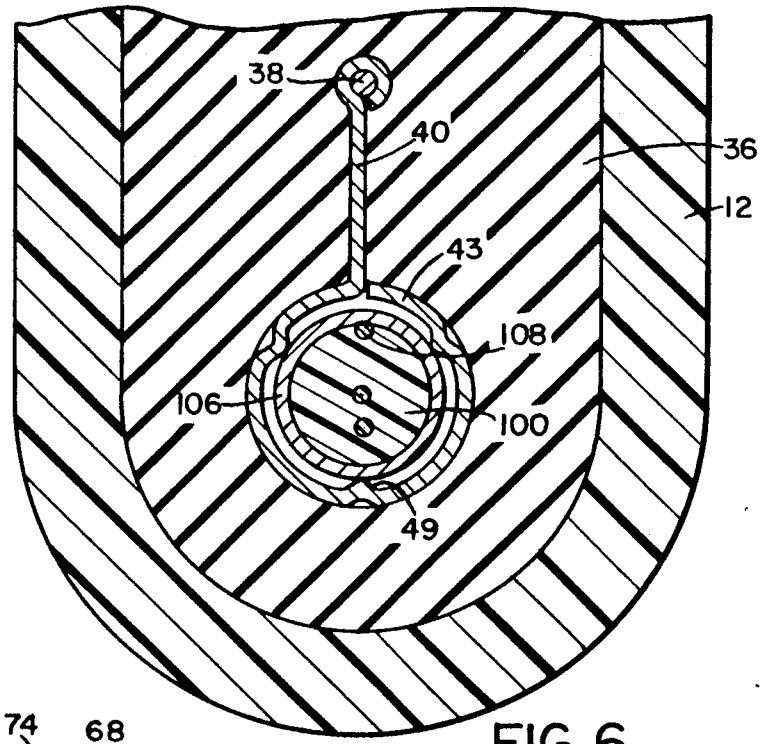
FIG. 6 is a sectional view taken on line 6—6 of FIG. 5.
Figure 7:
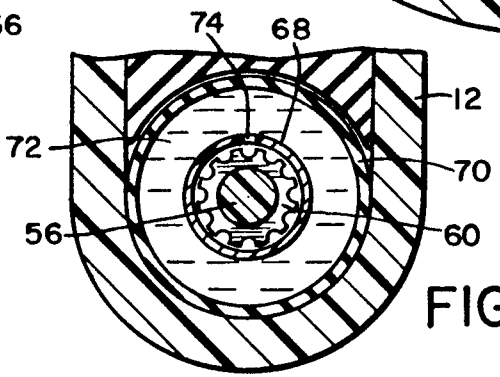
FIG. 7 is a sectional view taken on line 7—7 of FIG. 2.
Figure 5:
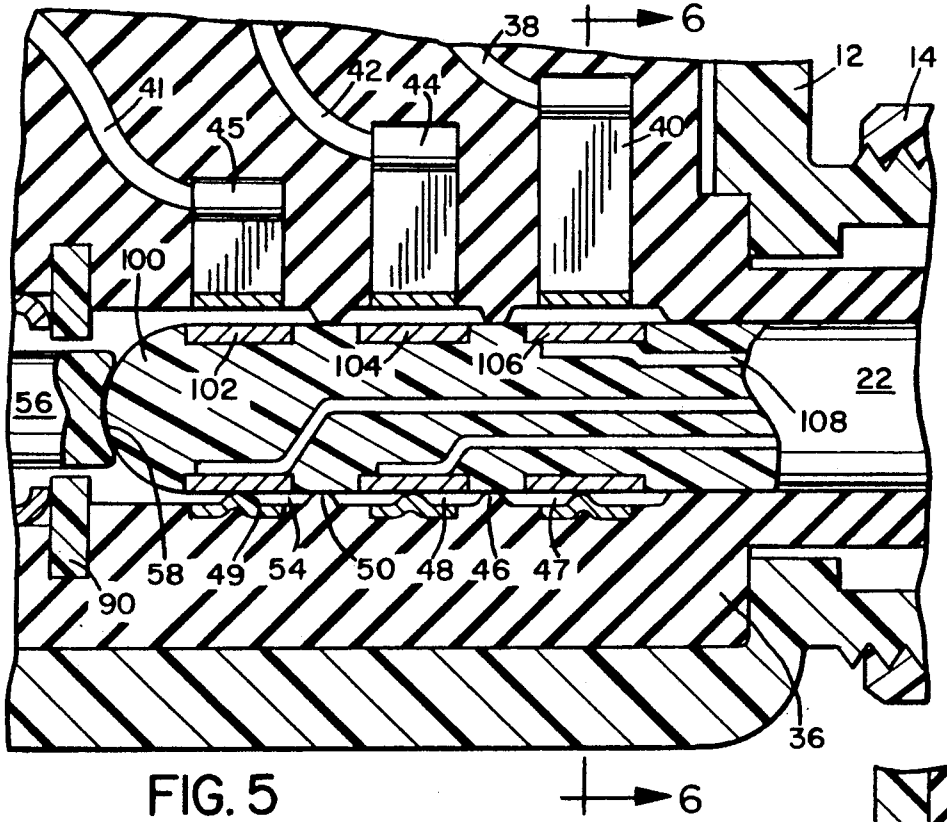
FIG. 5 is a further enlargement of a portion of FIG. 2.

The probe, see FIG. 4, comprises a dielectric probe end 100 that has respective ring electrical contacts 102, 104 and 106 that connect to connecting wires 108 that in turn are connected to the respective input lines 114 from cable 22. Probe 100 is held in position by a plastic sleeve 112 that fits around an elastometer sleeve 116, all of which are positioned within the outer elastometer housing 24. The threaded connector 14 as previously described, mates with respective threads 26 on the end of the receptacle 10 to make the electrical connection.

OPERATION

In making the electrical connection, see FIG. 2, the probe end 100 is inserted through the opening in the mated tooth surface 30 of the connector 10. Probe 100 enters opening 35 of the port 34 and contacts the concave end 58 of stopper 56, with the probe forcing stopper 56 to be moved to the retracted position. In this movement, the fluted end 60 is forced against the spring 62, to the retracted position illustrated in FIG. 2. The larger diameter probe 100 further expands the resilient opening 35 in port 34, increasing the sealing pressure of the resilient seal, and wiping the probe and maintaining the seal against the probe in its movement into the channel containing the in line electrical sockets 40, 44 and 45. As the larger diameter probe 100 passes through the smaller diameter openings of the respective wipers 46 and 50, the probe is further wiped until the probe is in the fully extended position illustrated in FIG. 2. Further the circumferential contact of the respective wipers 46 and 50 against the probe 100 form dielectric wiper baths in sealed volumes or chambers 47, 48 and 54. The respective contacts 102, 104 and 106 make electrical contact with sockets 45, 44 and 40. Since the wipers 46 and 50 are positioned between the sockets 40, 44 and 45, the respective electrical connections are made within sealed wiper chambers 47, 48 and 54. This provides a sealed wiper, dielectric bath chamber around each of the respective electrical connections, which chambers separate the respective electrical connections from the other electrical connections made in the electrical contact of the multiple contact probe with the multiple socket connector. The threaded coupling is then completed and the probe and receptacle are held in position and against rotation by the mated tooth surfaces 30 and 110.

In disconnecting the electrical connector, the threaded coupling 14 is disconnected and the probe 100 is pulled from the channel in the receptacle 10. This allows the spring 62 to bias the stopper 56 to force the probe out of the channel and to replace the probe in the receptacle channel of the connector 10. The stopper end 56 seals opening 35 in the port 34, and dielectric fluid from chamber 72 is allowed to flow around the fluted end 89 of the stopper end 60, see FIG. 7, and communicate with the respective wiper dielectric bath chambers 47 and 48, while the respective wipers 46 and 50 wipe dielectric fluid from the probe as it exits from port 34.

The respective contacts 102, 104 and 106 on the probe end 100 are molded into the dielectric base to provide a smooth external surface. This external surface is contacted by the respective indentations 49 on the ring portion 43 of the socket sleeve 40, see FIG. 6, making positive electrical contact without requiring raised electrical contact sleeves on the probe 40 that would damage the internal sealing surfaces of port 34 and the respective wipers 46 and 50. The dielectric fluid is inserted into the flexible bladder 70 by pushing the stopper 56 to the retracted position and inserting the fluid through the opening 35 of port 34.

Obviously, many variations of the invention are possible in light of these teachings which, when employed, will not deviate from the scope of the appended claims.

I hereby claim:

1. An underwater electrical connector comprising:

a flexible dielectric chamber having a channel with a plurality of dielectric baths for enclosing a plurality of electrical sockets in a dielectric fluid;

said flexible chamber and said dielectric baths having sealable openings;

a male probe having a plurality of spaced electrical contacts positioned in line for being inserted through said sealable openings and contacting said plurality of electrical sockets;

a dielectric stopper disposed in said channel for moving from a first position in said sealable opening of said flexible chamber to a second retracted position exposing said sockets;

said probe being movable to contact and move said stopper to the retracted position and movable through said channel to seal said sealable openings, making multiple contacts with said sockets in the dielectric baths in said flexible dielectric chamber;

said sealable openings of said dielectric baths comprising a plurality of inner, spaced wipers for wiping the outer surface of said probe in movement in said channel;

each of said wipers having an inwardly biased circular surface that contacts the outer surface of said probe between respective ones of said electrical contacts forming said dielectric baths for separately enclosing respective ones of said electrical contacts;

said stopper and said probe having an outer surface with respective diameters, with the diameter of said probe being larger than the diameter of said stopper; and said wipers having an inward circular opening with a diameter that is larger than the diameter of said stopper, and smaller than the diameter of said probe.

2. An underwater electrical connector comprising:

a flexible dielectric chamber having a channel with a plurality of dielectric baths for enclosing a plurality of electrical sockets in a dielectric fluid;

said flexible chamber and said dielectric baths having sealable openings;

a male probe having a plurality of spaced electrical contacts positioned in line for being inserted through said sealable openings and contacting said plurality of electrical sockets;

a dielectric stopper disposed in said channel for moving from a first position in said sealable opening of said flexible chamber to a second retracted position exposing said sockets;

said probe being movable to contact and move said stopper to the retracted position and movable through said channel to seal said sealable openings, making multiple contacts with said sockets in the dielectric baths in said flexible dielectric chamber;

said sealable openings of said dielectric baths comprising a plurality of inner, spaced wipers for wiping the outer surface of said probe in movement in said channel; each of said wipers having an inwardly biased, circular surface that contacts the outer surface of said probe between respective ones of said electrical contacts; and the outer diameter of said stopper being smaller than the inner diameter of the contacted circular surface of said wipers, allowing direct fluid communication between said dielectric baths in said flexible chamber when said stopper is in the first position.

3. An underwater electrical connector comprising:

a flexible chamber having a channel for enclosing a plurality of electrical sockets in a dielectric fluid and having a sealable opening at one end;

a probe having a plurality of spaced electrical contacts positioned in line for being inserted through said sealable openings and contacting said plurality of electrical sockets;

a dielectric stopper disposed in said channel for moving from a first position in said sealable opening to a second retracted position exposing said sockets;

said channel having a plurality of fluid interconnecting, sealable dielectric bath chambers, each of which encloses individual electrical connections of said contacts to said sockets;

wiper means being spaced one from the other to correspond with the space between the electrical contacts on said probe, to form said sealable dielectric bath chambers around connections of respective ones of said contacts with said sockets;

said stopper and said probe having outside diameters; and the outer diameter of said stopper being smaller than the outer diameter of said probe, and said stopper diameter being smaller than the inner diameter of said wiper means.

* * * * *